US007063110B2

(12) United States Patent
Chen

(10) Patent No.: US 7,063,110 B2
(45) Date of Patent: Jun. 20, 2006

(54) CUTTING DEVICE FOR A METAL BAND BUNDLING APPARATUS

(76) Inventor: Hsiu-Man Yu Chen, No. 27, Sec. 1, Ta Fu Road, Tan Tzu Hsiang, Taichung (TW) 427

( * ) Notice: Subject to any disclaimer, the term of this patent is extended or adjusted under 35 U.S.C. 154(b) by 30 days.

(21) Appl. No.: 10/873,174

(22) Filed: Jun. 23, 2004

(65) Prior Publication Data

US 2005/0284534 A1 Dec. 29, 2005

(51) Int. Cl.
*B21F 11/00* (2006.01)

(52) U.S. Cl. ..... 140/123.6; 140/93.2

(58) Field of Classification Search ..... 140/123.6, 140/93.2, 152; 7/132, 134; 101/31.1
See application file for complete search history.

(56) References Cited

U.S. PATENT DOCUMENTS 4,688,607 A * 8/1987 Wolcott ..... 140/93.2
4,726,403 A * 2/1988 Young et al. ..... 140/93.4
5,392,821 A * 2/1995 Chudy ..... 140/93.2
D395,582 S * 6/1998 Smith ..... D8/10
5,975,150 A * 11/1999 Barlasov et al. ..... 140/93.4

* cited by examiner

*Primary Examiner*—Derris H. Banks
*Assistant Examiner*—Teresa M Bonk
(74) *Attorney, Agent, or Firm*—Troxell Law Office, PLLC

(57) ABSTRACT

A cutting device for a metal band bundling apparatus includes a band guider, a rotatable knife fitted in a hole of the band guider fixed on a first handle of a metal band bundling apparatus, and a press rod connected with the knife. The press rod consists of a bent portion and a press portion, and the bent portion located to pass across over the first handle and a second handle. A user can hold the grip portions of the first and the second handle with four fingers of a hand and presses the press portion with the thumb of the hand to rotate the rod-shaped knife for a certain angle to cut off a metal band. So cutting operation can be preformed with the thumb of a hand only, very easy and quick to operate after bundling an object with the metal band.

1 Claim, 4 Drawing Sheets

CUTTING DEVICE FOR A METAL BAND BUNDLING APPARATUS

BACKGROUND OF THE INVENTION

1. Field of the Invention

This invention relates to a metal band bundling apparatus, particularly to one having a cutting device to cut quickly a metal band by pressing with the thumb of a hand only, provided with a simple structure.

2. Description of the Prior Art

A conventional metal band bundling apparatus is used for bundling a metal band on an object, with the metal band passing through a guiding device, and then pressing it with a actuating plate to pinch it between the actuating plate and the apparatus body. Then the metal band is pulled tightly to bundle the object.

However, the metal band is usually left with a certain length after it is bundled tightly, so that left length has to be cut off directly with another tool, or to be twisted off by clamping with the apparatus. And another tool is necessary beside the conventional metal band bundling apparatus, as it has no cutting device. Moreover, if the metal band is twisted off, its cut edge may be rugged, or the metal band may be broken if worse.

SUMMARY OF THE INVENTION

This invention has been devised to offer a cutting device for a metal band bundling apparatus, which has a rotatable rod-shaped knife with a blade fitted in a hole of a band guider fixed on an upper end of a first handle of a metal band bundling apparatus, and a press rod connected in a right angle with a rear end of the knife. The press rod has a bent portion of a preset length to pass over a first and a second handle of the apparatus to reach near a grip of the second handle, and a press portion continuing rearward to the bent portion is to be pressed by the thumb of a hand of a user for cutting a metal band after bundling around an object. When the press portion of the press rod is pressed by the user, the knife is rotated for a certain angle to cut off the metal band, with pressing action of the thumb of one hand only, with the other four fingers still holding the grips of the two handles, very easy and convenient to operate.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
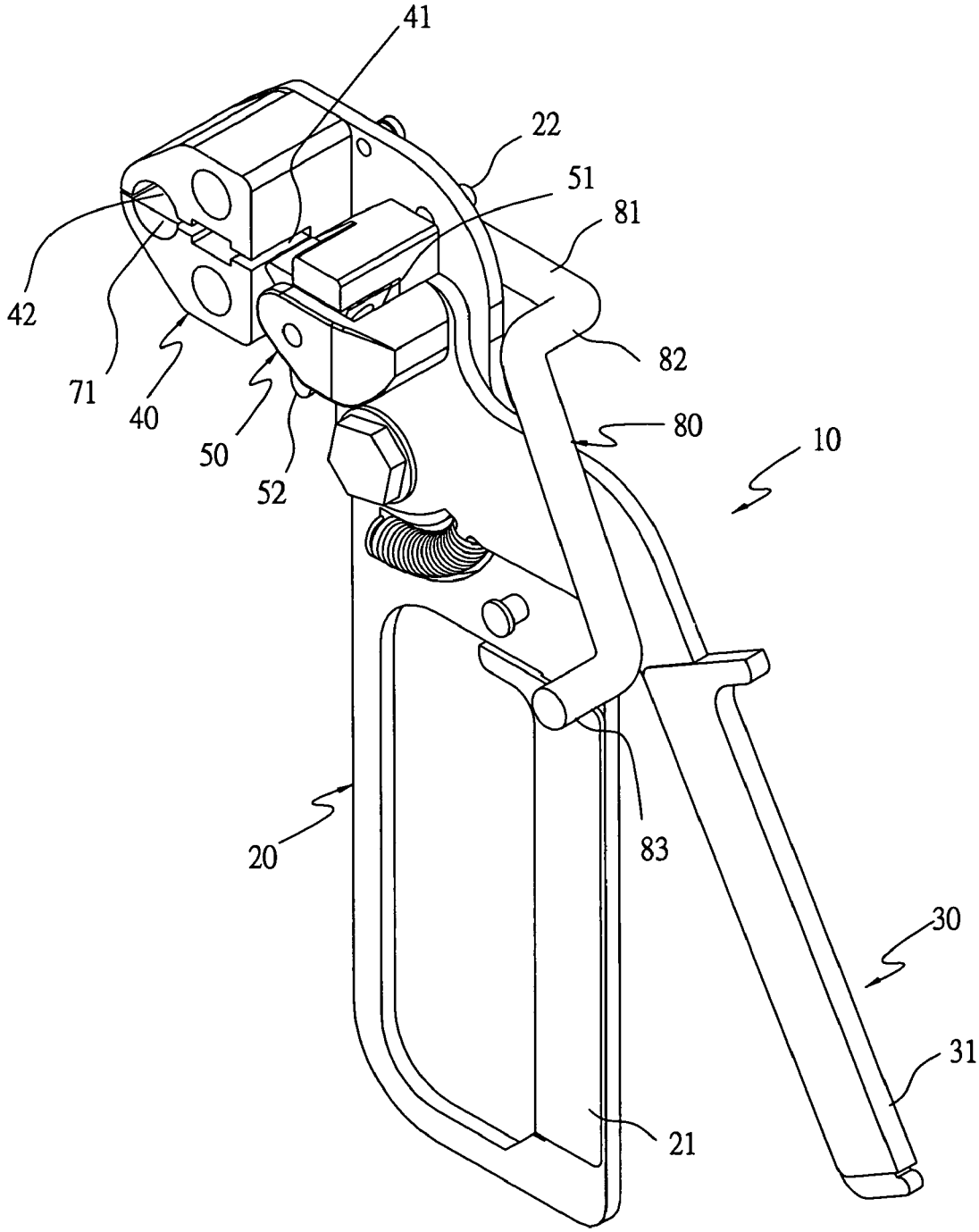
FIG. 1 is a perspective view of a metal band bundling apparatus provided with a cutting device in the present invention.
Figure 2:
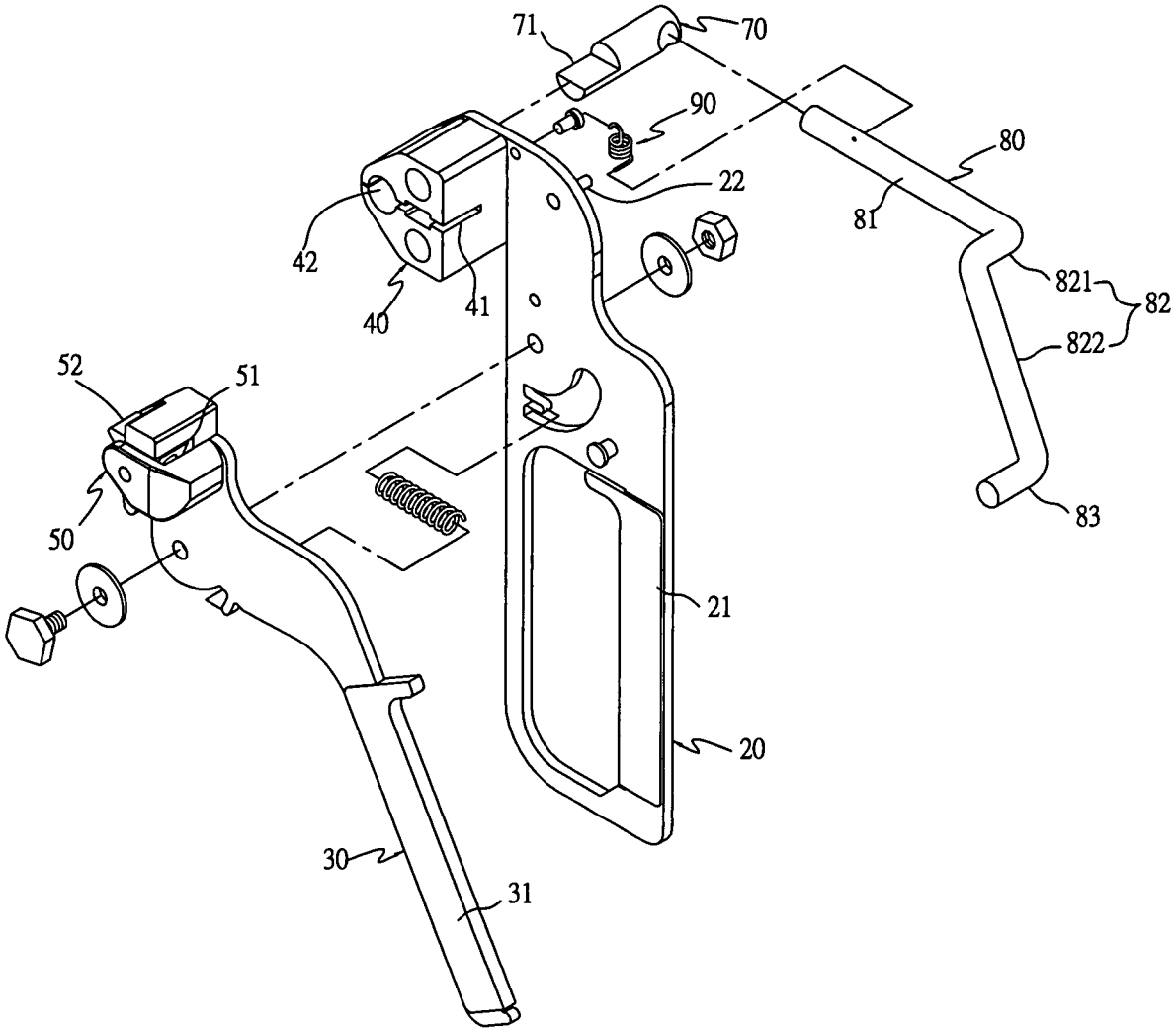
FIG. 2 is an exploded perspective view of the metal band bundling apparatus with the cutting device in the present invention.
Figure 3:
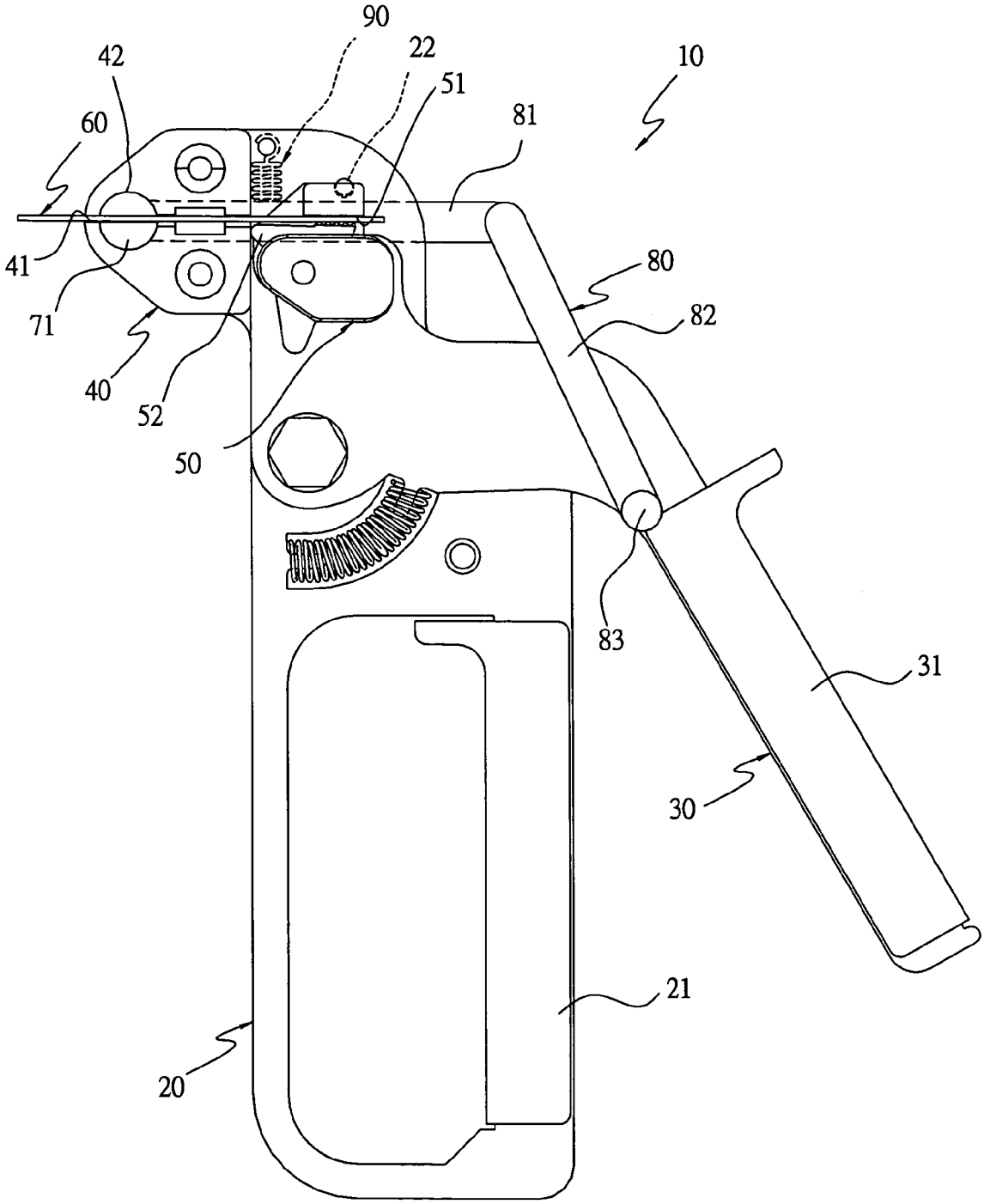
FIG. 3 is a side view of the metal band bundling apparatus with the cutting device in the present invention.

A preferred embodiment of a cutting device for a metal band bundliing apparatus is combined with a metal band bundling apparatus with the similar structure as a conventional metal band bundling apparatus, which includes a first clamp handle 20 and a second clamp handle 30, as shown in FIGS. 1, 2 and 3. The first and the second clamp handle 20 and 30 respectively have grip portions 21 and 31 that form an acute angle and may be clamped to each other for clamping a metal band elastically. Further, a band guider 40 is provided on the upper end of the first handle 20, having an aperture 41 for a metal band 60 to pass through, and a tightening unit 50 is provided on the upper end of hte second handle 30, having a passageway 51 for the metal band 60 to pass through after passing through the band guider 40, and elastic retreat blocker 52 provided under the passageway 51 for pressing, pinching and pulling the metal band 60 having passed the passageway 51.

The first handle 20 further has at least one limit rod 22 laterally provided on the other side of the upper end provided with the band guider 40.

The cutting device includes the band guider 40, the tightening device 50, a knife 70, a press rod 80 and a spring 90.

The band guider 40 further has a hole 42 laterally near the front end of the aperture 41.

The cutting device includes a knife 70 and a press rod 80.

The knife 70 is rod-shaped, fitted rotatably in hte hole 42 of the band guider 4, having a semi-column blade 71 so as to cut off a metal band 60 by rotation of the knife 70.

The press rod 80 has a front end to be connected with the rear end of the blade 71, a first lengthwise rod portion 81 extending toward the knife 70, a lateral rod portion 821 extending from the end of the first lengthwise rod portion 81, a bent rod portion 82 extending rearward from the first rod portion 81 to form the first lateral rod 821 and a second lengthwise rod portion 822, and a pushing portion 83 extending laterally from the second lengthwise rod portion 822. Then the press rod 80 is located in parallel to the first handle 20, with the first lateral rod portion 821 of the bent rod portion 82 positioned overriding the first and the second handle 20 and 30. At the same time, the second lengthwise rod portion 821 of the bent portion 82 reaches near the grip portion 31 of the second handle 30, enabling the thumb of a hand of a user press the bent portion 83 to rotate the knife 70 for a certain angle for cutting the metal band 60, and the press rod 80 may also be blocked by the limit rod 22 of the first handle 20 to stay at its original position.

The spring 90 has one end fixed on the wall opposite to the band guider 40 on the upper end of hte first handle 20, and the other end located near the knife 70 for pushing back the press rod 80 to is original position after pressed.

Figure 4:
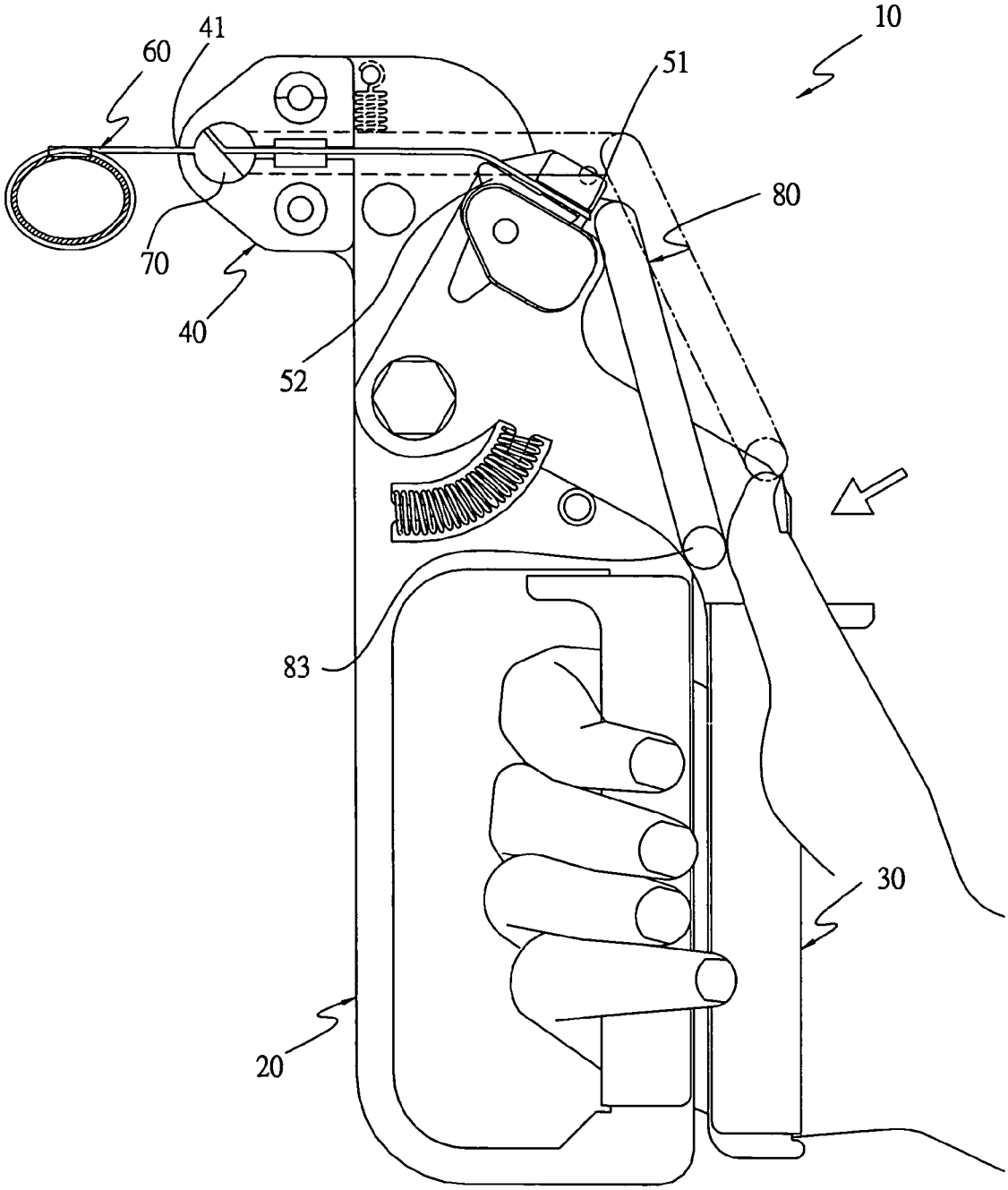
FIG. 4 is a side view of the metal band bundling apparatus with the cutting device in the present invention, showing it under a tightening and pressingly cutting condition.

Next, how to use the metal band bundling apparatus in the invention is to be described. First, referring to FIGS. 3 and 4, the metal band 60 is bundled around an object, and the end of the metal band 60 is inserted through the aperture 41 of the band guider 40, extending along beside the blade of the knife 70 and then through the passageway 51 of the tightening unit 50. Then the user holds and elastically pinches the two handles 20 adn 30 together with four fingers of a hand, letting the retreat blocker 52 pressing down the metal band 60 and tightly pulling back intermittently so as to gradually bundle the object. It is particularly necesary to mention that when the user pinches the two handles 20 and 30 together for hte last time to complete bundling action to the object, the user presses the press rod 80 with the thumb of the hand only to force the knife 70 to rotate clockwise for a certain angle so the blade 71 may cut the metal band 60, not needing any other cutting tool.

The cutting device for a metal band bundling apparatus according to the inveintoin has the following advantages, as can be understood from teh foresaid description.

1. The metal band bundling apparatus 10 with the cutting device possesses both bundling and cutting function, effectively improve the efficiency and practicability.

2. A user can use the thumb of one hand only to press the press rod 80 to cut off the metal band 60 easily and quickly without any other cutting tool.

3. Cutting action can be performed by the thumb of a hand only, with the other fingers still possible to grip the two handles 20 nad 30, very convenient and simple to operate.

While the preferred embodiment of hte invention has been described above, it will be understood that various modifications may be made therein and the appended claims are intended to cover all such modifications that may fall within teh spirit and scope of the invention.

What is claimed is:

1. A cutting device for a metal band bundling apparatus, said metal band bundling apparatus having a first handle and a second handle, said first and said second handle respectively provided with a grip portion forming an acute angle to each other, said cutting device comprising:

a band guider fixed on a front side of an upper end of said first handle and a tightening unit fixed on a front side of an upper end of said second handle;

said band guider provided with an aperture for a metal band to pass through., and a hole bored laterally at a front side of said aperture;

a knife of a rod shape fitted rotatively in said hole of said band guider and having a blade facing to said aperture;

a press rod having an upper end connected in a right angle with a rear end of said knife, and a bent portion of a certain length passing over said first handle and said second handle to reach near said grip of said second handle, a pushing portion extending bent from a rear end of said bent portion for the thumb of a hand of a user to press while the other four fingers are holding said grip portions of said first and said second handle, said knife rotated for a certain angle to cut off the metal band when said press portion is pressed by only the thumb of one hand of the user; and a spring having a first end fixed on the upper end of said first handle, and a second end fixed on said press rod near said knife, pushing back said press rod elastically to its original position after pressed, wherein the side opposite to said band guider of said upper end of said first handle is provide with at least a sidewise limit rod for blocking normally said press rod.

* * * * *